US007380611B2

(12) United States Patent
Östling

(10) Patent No.: US 7,380,611 B2
(45) Date of Patent: Jun. 3, 2008

(54) ROCK DRILLING MACHINE AND ROCK DRILLING SYSTEM

(75) Inventor: Thomas Östling, Eskilstuna (SE)

(73) Assignee: Atlas Copco Rock Drills AB, Orebro (SE)

( * ) Notice: Subject to any disclaimer, the term of this patent is extended or adjusted under 35 U.S.C. 154(b) by 35 days.

(21) Appl. No.: 11/342,164

(22) Filed: Jan. 27, 2006

(65) Prior Publication Data

US 2007/0137874 A1 Jun. 21, 2007

(30) Foreign Application Priority Data

Dec. 19, 2005 (DE) ..... 20 2005 019 913 U

(51) Int. Cl.
*E21B 3/02* (2006.01)

(52) U.S. Cl. ..... 173/28; 173/42; 173/147; 173/152; 173/199; 173/218

(58) Field of Classification Search ..... 173/28, 173/29, 189, 198, 199, 147, 42, 44, 185, 173/218, 152
See application file for complete search history.

(56) References Cited

U.S. PATENT DOCUMENTS 3,684,035 A * 8/1972 Wills ..... 173/147
4,064,950 A * 12/1977 Salmi et al. ..... 173/151
4,262,754 A * 4/1981 Nelson ..... 173/196
4,497,378 A * 2/1985 Beney et al. ..... 173/32
5,251,709 A * 10/1993 Richardson ..... 175/220
6,105,684 A * 8/2000 Pointer et al. ..... 173/27
6,263,985 B1 * 7/2001 Scheid et al. ..... 175/162
6,604,586 B2 * 8/2003 Tremblay ..... 175/171
6,732,814 B2 * 5/2004 Heinonen et al. ..... 173/199
6,814,155 B1 * 11/2004 Nielson et al. ..... 173/152
6,896,072 B2 * 5/2005 MacDonald ..... 173/192

* cited by examiner

*Primary Examiner*—Scott A. Smith
(74) *Attorney, Agent, or Firm*—Mark P. Stone

(57) ABSTRACT

A rock drilling machine (1) having, on a machine housing (2), a first attachment element on a first attachment side (13) for its fastening to a slide member which is movable back and forth along a feed beam, the attachment element having a contacting surface (17) for co-operation with a contacting element supported by the slide and a fastening element (18, 19) for the engagement with fasteners co-operating with the slide. The machine is distinguished by the rock drilling machine (1) being provided also with a second attachment element on a second attachment side (15), the second attachment element being configured similarly to the first attachment element, having a contacting surface (17) and fastening element (18, 19), to allow the rock drilling machine (1) to be fastened to the slide member also with the second attachment element. A rock drilling system has the rock drilling machine as one of its components.

20 Claims, 6 Drawing Sheets

ROCK DRILLING MACHINE AND ROCK DRILLING SYSTEM

FIELD OF THE INVENTION

The invention concerns a rock drilling machine having, on a machine housing, first attachment means on a first attachment side for its fastening to a slide member which is movable back and forth along a feed beam, said attachment means including a contacting surface for co-operation with contacting means supported by the slide and fastening means for the engagement with fasteners co-operating with the slide. The invention also concerns a rock drilling system including such a rock drilling machine.

BACKGROUND OF THE INVENTION

In blast hole drilling it is i.a. important to come close to the rock face of the already finished part of the tunnel or gallery in order to position blast holes as near to parallel with the extension of the imagined tunnel as possible. For that reason there is a desire to keep the dimensions of the rock drilling machine above a drill string axis as small as possible.

For that reason a drill rig having left and a right rig arms are typically equipped with a left and a right version rock drilling machine which is each optimized for the minimizing of said dimensions in each case. Previous rock drilling machines typically have an underside for mounting against a slide, an upper side allowing the desired small distance to the drill string axis and left and right sides preferably also having reduced protrusion.

The fluid inlet and hose arrangements in previous rock drilling machines are typically configured so as to be best adapted for the particular machine. In a known drilling machine there are double inlets/outlets for left and right attachment, half of which having to be plugged for operation which leads to leakage problems, higher costs and cumbersome construction.

AIM AND MOST IMPORTANT FEATURES OF THE INVENTION

It is an aim of this invention to provide a rock drilling machine and a rock drilling system that offer better economy and better flexibility in connection with rock drilling machines for rock drill rigs for driving tunnels and galleries.

That aim is obtained through the features of the characterizing portion of claim 1. Hereby it is possible to use one and the same version rock drilling machine for left and right use without the need of having separate left and right versions. The flexibility is increased as well as handling, service and overall economy.

The rock drilling machine according to the invention can be turned so that either of the two sides can be mounted upwardly or, to be more specific, against the rock face. By keeping the dimensions of the machine small from each attachment side it is thereby possible to come close to the rock face with the drilled hole in both directions of the drilling machine.

The contacting surface includes preferably a shallow bottom hole and most preferred with circular section, which gives a rigid and flexible attachment.

It is preferred that the first and the second attachment sides face essentially opposition directions, which gives best flexibility in normal rock drilling situations.

By locating at least one and preferably all of the inlets and outlets of the group: lubrication air, percussion fluid, rotation fluid, flushing fluid, damper fluid, drainage fluid so as to be directly directed opposite to the drilling direction of the machine, the possibility of positioning of the hoses in protected positions is enhanced.

By locating all the inlets and outlets to and from the machine and in particular chosen from the group: lubrication air, percussion fluid, rotation fluid, flushing fluid, damper fluid, drainage fluid; on one and the same side, which is not an attachment side, all hoses that connects to the machine can be easily handled.

This also allows a clean and collected positioning of the associated hoses that extend from the inlets and outlets of the rock drilling machine. This in combination with a possible turning of the drilling machine gives the opportunity to choose whether the hoses are to be positioned to the right or to the left, which facilitates the adequate mounting of the drilling machine on a rig.

Such localisation of the inlets/outlets also brings along the further advantage that since the inlet/outlet nipples extending from the machine housing are directed rearwardly, against the hose drum, better protection from wear and damages also of these nipples will result.

It is also easy to collect all hoses inwardly where they extend protected from abrasive rock face contact on a rig having two beams.

A further mounting alternative is to mount the rock drilling machine with the side with the hoses facing upwardly when small dimensions in a vertical direction is not crucial, but where it is a desire to achieve a sideways "thin" machine.

It is preferred that the inlets and outlets are positioned at a distance from an end of the machine housing opposite to a drill string end in order to gain, that is reduce, important machine length, because the system including the drilling machine, the hose drum etc. can be allowed to be shorter as seen in an axial direction of the machine. This is because the hoses can not be bent close to a nipple, since they are relatively stiff in that area.

Further advantages of the invention will be apparent from the following detailed description of an embodiment.

BRIEF DESCRIPTION OF DRAWINGS

The invention will now be described in more detail at the background of an embodiment and with reference to the annexed drawings, wherein.

DESCRIPTION OF EMBODIMENT

Figure 1:
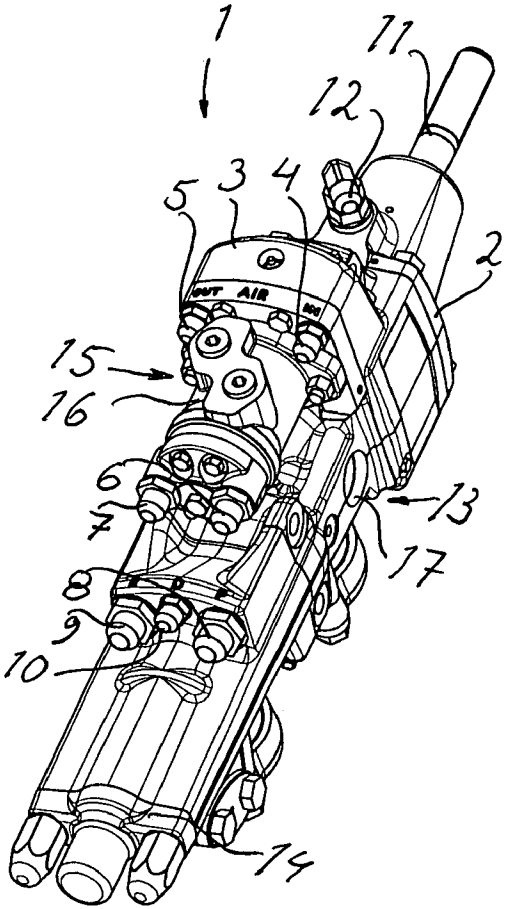
FIG. 1 shows a rock drilling machine according to the invention in a perspective view.

In FIG. 1 a rock drilling machine 1 is shown having a machine housing 2 defining a drill steel end with a drill steel shank 11 and a rear end 14.

The machine housing 2 has a first attachment side 13 and a second attachment side (shown on FIG. 2) indicated with an arrow at 15. A contacting surface being the circumference surface of a shallow circular hole is indicated with 17.

On one side of the drilling machine which is not an attachment side there extends a gear housing 3 having an inlet 4 and an outlet 5 for lubrication air, which are equipped with nipples that are directed rearwardly of the rock drilling machine.

On the same side there is a positioned a rotation unit 16 having an inlet 6 and an outlet 7 for rotation fluid. The nipples of the inlet and outlet, respectively, are also directed rearwardly of the rock drilling machine. On the same side there are arranged an inlet 8 and an outlet 9 for percussion fluid to a hammer unit which is included in the rock drilling machine. The nipples for the percussion fluid inlet and outlet are directed so as to form a small angle to the general axis of the rock drilling machine but are directed essentially rearwardly.

An angular nipple 12 having an L-configuration is arranged at the front end of the rock drilling machine, and has a portion directed generally rearwardly for inlet of flushing fluid to be transmitted to a drill bit at the end of the drill steel. The angular nipple 12 is intended to be adjusted so that a hose extending therefrom passes on a chosen side of the machine housing in operation of the rock drilling machine.

By having all inlets outlet on a side of the machine, at a distance from the rear end 14, the dead length behind the machine can be minimized.

10 indicates a nipple for damper fluid. This nipple is positioned between the nipples 8 and 9 for percussion fluid and is directed in essentially the same direction.

Figure 2:
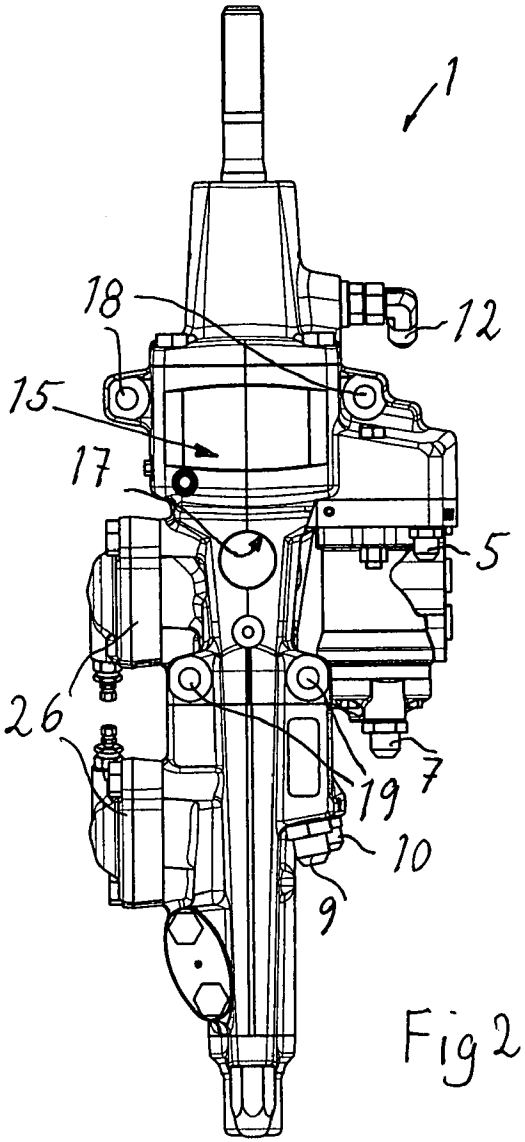
FIG. 2 shows a rock drilling machine of FIG. 1 in a plane view.

FIG. 2 shows the second attachment side 15 of the rock drilling machine 1. On the second attachment side there is also a contacting surface 17 (as in FIG. 1) in the form of a shallow, circular bottom hole for receiving a corresponding circular rigid stud which protrudes from the slide. The two elements indicated at 18 are fastening means in the form of front fastener holes and the two elements 19 are fastening means being rear fastener holes, all four elements being through-holes adapted for receiving screw fasteners extending through the holes and intended to engage mating means on the slide.

Figure 3A:
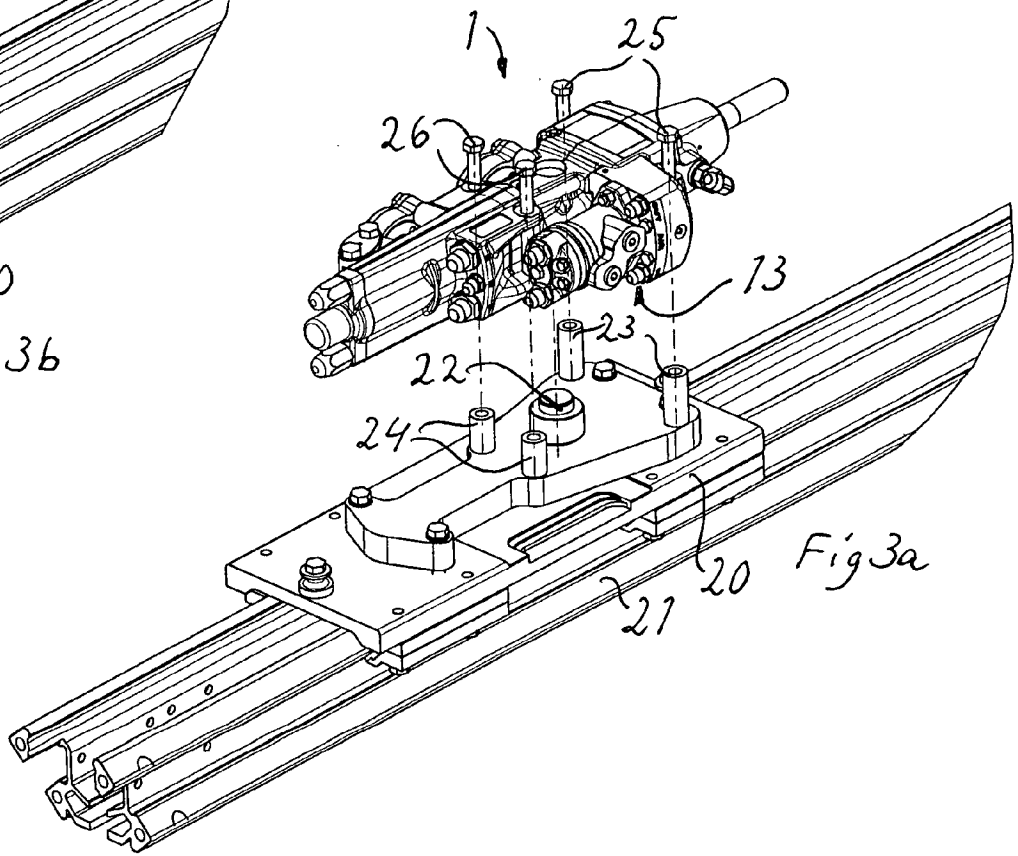
FIGS. 3*a* and 3*b* shows the rock drilling machine of FIGS. 1 and 2 prior to being attached to a slide member on a first attachment side and a second attachment side, respectively.
Figure 7:
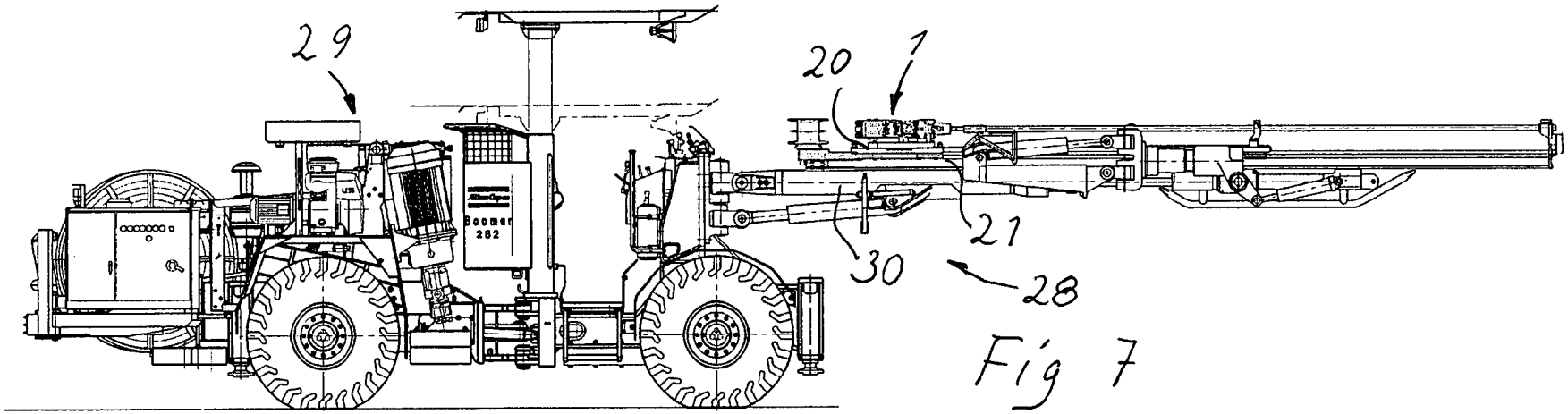
FIG. 7 shows a drill rig including a drilling machine according to the invention.

FIG. 3*a* shows the drilling machine 1 prior to being attached on a slide 20 to its first attachment side 13. 21 indicates a feed beam belonging to a drill rig (see FIG. 7). A rigid support means in the form of a short stud member 22 extends at a right angle from the slide and is outermost portion provided with an engagement surface in the form of a circumference surface that fits with the contacting circumference surfaces 17 on the drilling machine so as to transmit essentially axial forces between the slide and the drilling machine. Fastening with the aid of elements 17, 18 and 19 positioned in only one housing portion results in that forces are transmitted between the machine and the slide against only said one single housing portion whereby bending strains on the machine are avoided or at least reduced.

Fastening screws 25 and 26 are arranged so as to penetrate holes 19 and 18 in the drilling machine so as to fix it to the slide. Distance sleeves 23 and 24 are arranged and measured so as to provide the accurate relative positioning in vertical directions, as seen in FIG. 3*a*, of the devices at attachment.

Figure 3B:
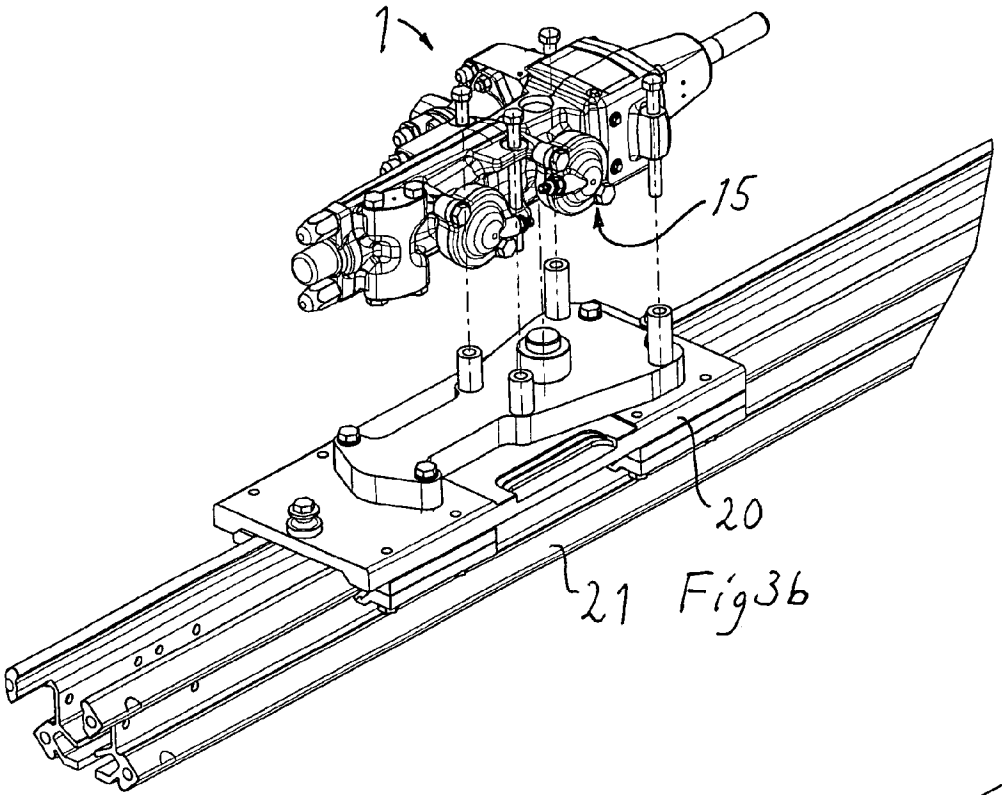
Figure 3C:
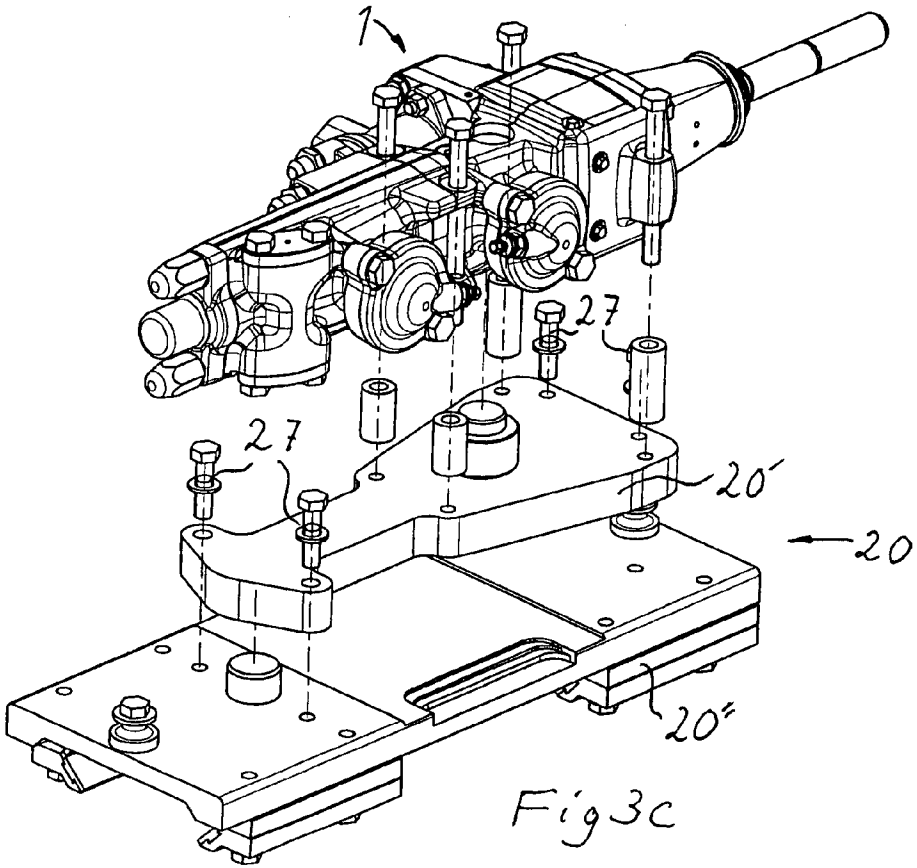
FIG. 3*c* shows the rock drilling machine, an adaptor plate, and a slide in an exploded view.

FIG. 3*b* shows the drilling machine 1 prior to being attached on its second attachment side 15 to the slide 20. FIG. 3*c* shows in more detail the parts for the attachment of the drilling machine 1 and the slide 20 with the part 20' being an engagement plate which is fastenable to the part 20" being a sliding element. The latter are fixable together over engagement means 27 and other load receiving means. In an alternative embodiment, the parts 20' and 20" are integrated into one single element.

Figure 4A:
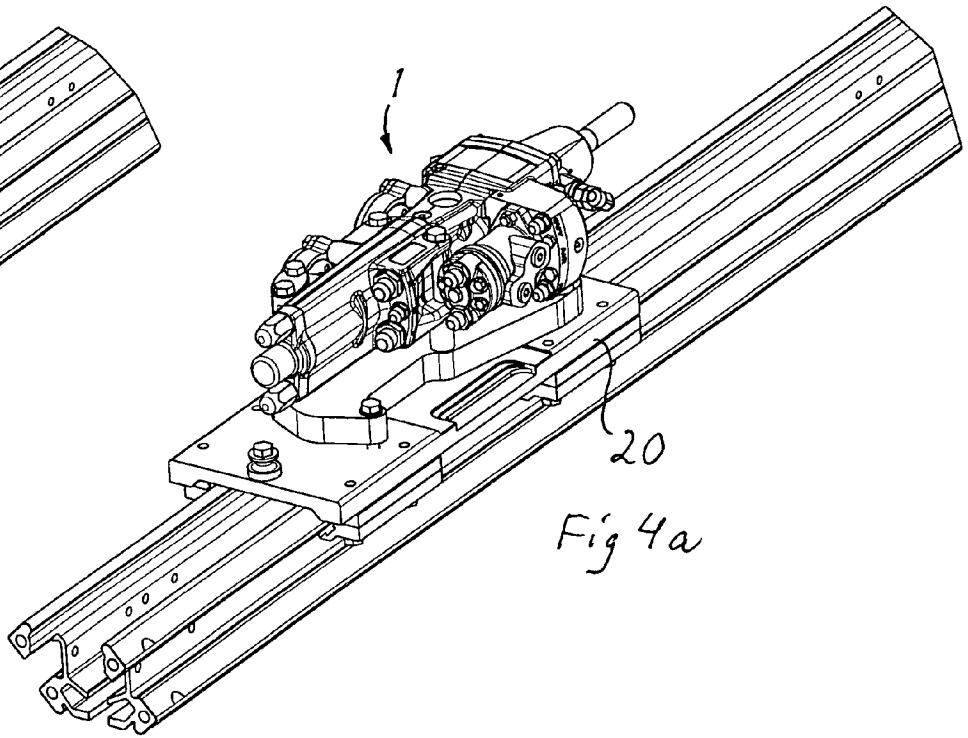
FIGS. 4*a* and 4*b* shows the rock drilling machine of FIGS. 1 and 2 being attached to the slide member on a first attachment side and a second attachment side, respectively, FIGS. 5*a, b* and *c* show three different hose arrangements for a rock drilling system including a rock drilling machine according to the invention.
Figure 4B:
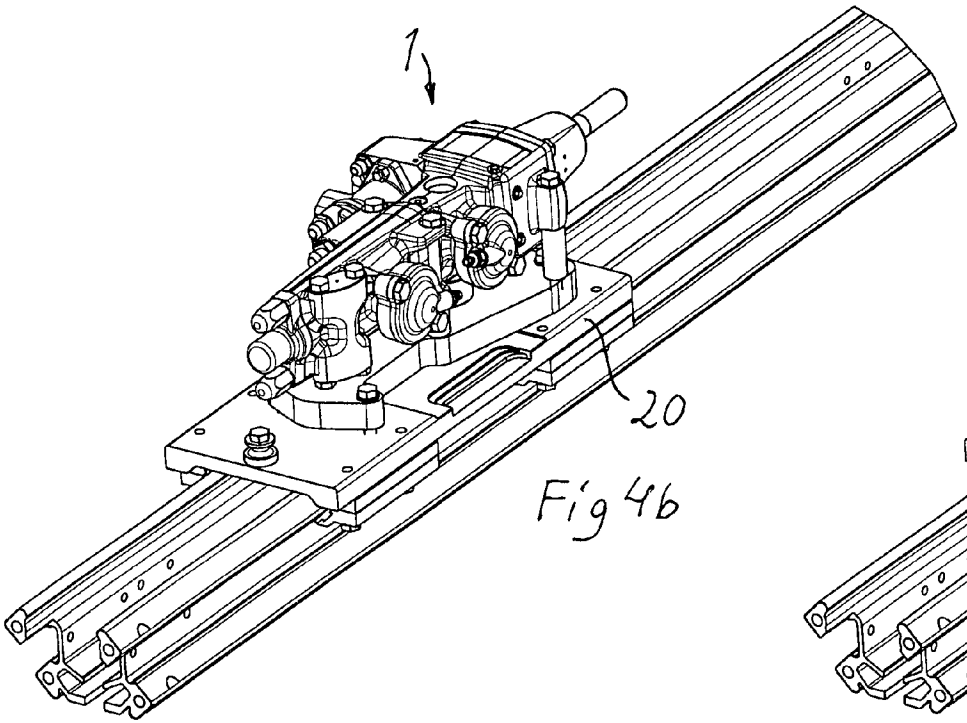

FIG. 4*a* shows the drilling machine 1 being attached on its first attachment side 15 to the slide 20 and FIG. 4*b* shows the drilling machine 1 being attached on its second attachment side 15 to the slide 20.

Figure 5A:
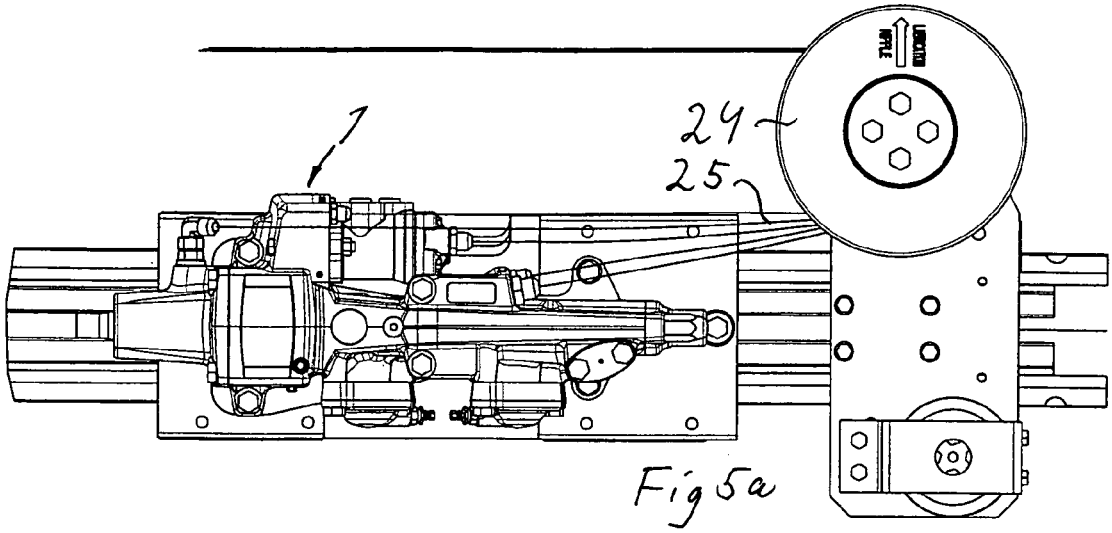
Figure 5B:
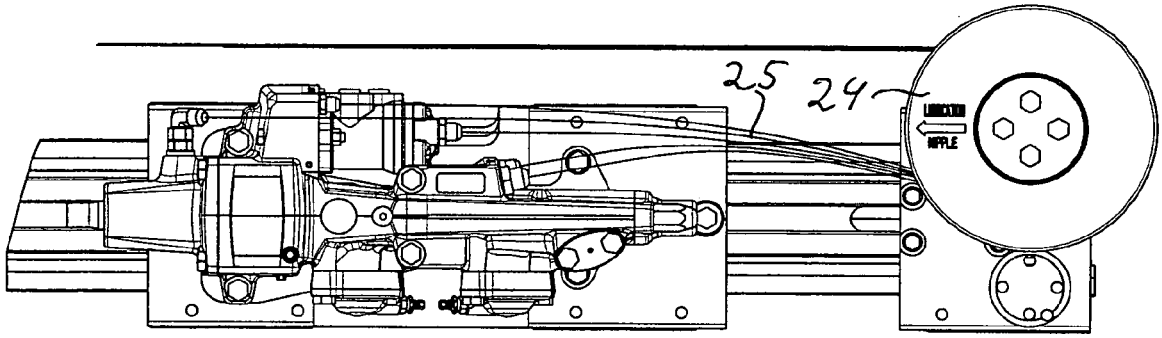
Figure 5C:
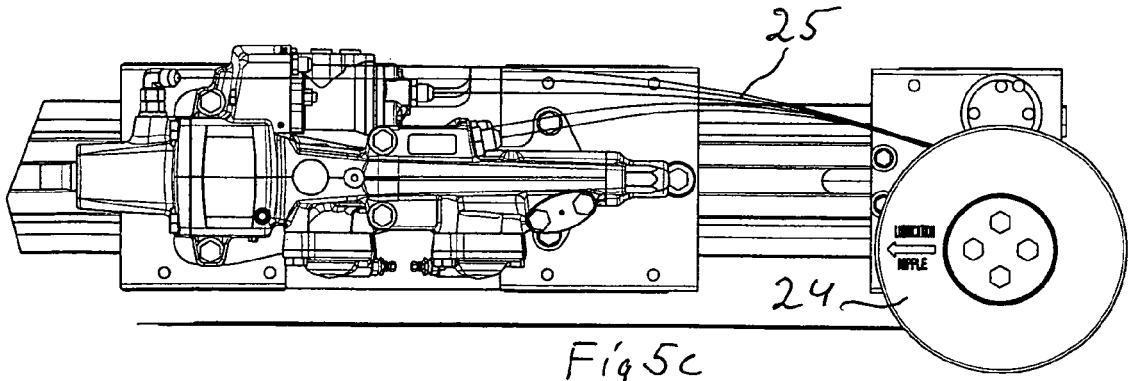

In FIGS. 5*a, b* and *c* are shown different arrangements of hoses 25 extending from the rock drilling machine 1, wherein a hose drum 24 is positioned rearwardly of the rock drilling machine 1. Hoses 25 are collected and bent over the rotational drum 24 so as to extend to various pumps etc. In FIG. 5*a* an arrangement of hoses 25 is shown, wherein the drum 24 is positioned more sideways of the rock drilling machine 1 and the hoses bent outwardly as seen from the machine. This solution gives a short arrangement and thereby the possibility to achieve longer travelling length in operation. FIGS. 5*b* and *c* are two different versions where the hoses are drawn closer to the drilling machine on the one side or the other side. Similar arrangements are of course possible with respect of machines mounted on the other attachment side.

Figure 6:
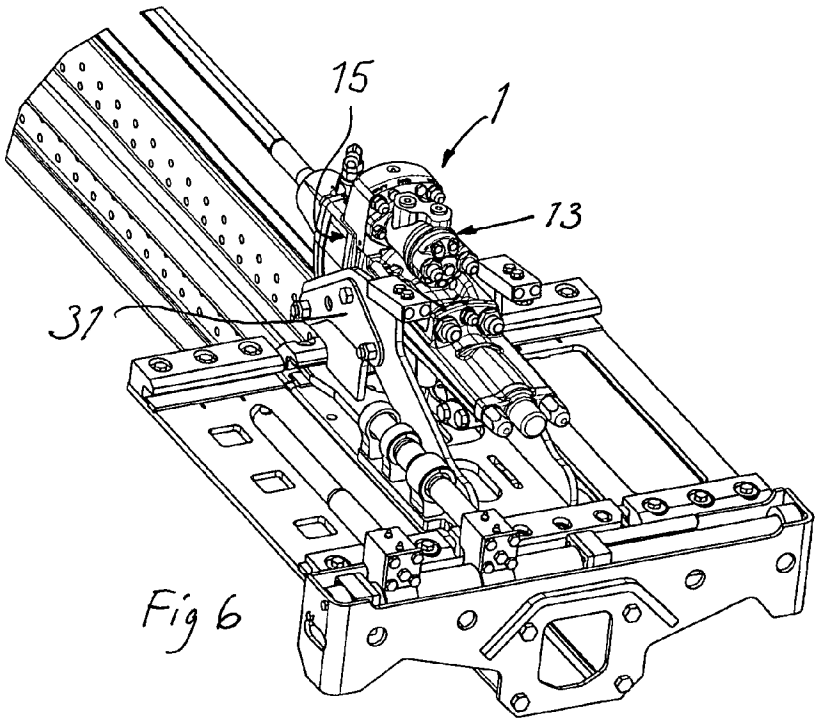
FIG. 6 shows a rock drilling machine on an alternatively configured attachment device.

FIG. 6 shows the drilling machine 1 attached to a slide over a holder 31 having fastening brackets extending upwardly from the slide so as to engage both sides of the drilling machine, which gives a very rigid fastening, and to position it with a "small side" towards the slide with the attachment sides 15 and 13 perpendicular to a general plane of the slide. This attachment is preferred on some rigs.

FIG. 7 shows a rock drilling rig 28 including a carrier vehicle 29, a boom 30, the feed beam 21, the slide 20 and the rock drilling machine 1.

The invention may be modified within the scope of the invention and to the extent that the attachment sides can be configured differently. It is desired that the rock drilling machine according to the invention is to a high extent symmetrical, which is the case with the embodiment shown on the drawings, but this is not necessary.

The attachment sides are preferably essentially parallel but other solutions; wherein the sides extend at an angle to each other are also possible. The means for attachment can be constructed otherwise, for example with other fastening elements and alternatively constructed surfaces for the co-operation with the slide.

It is preferred that the inlets and outlets are positioned and directed in general according to the shown embodiment, but other solutions are possible within the scope of the invention, also with hoses extending sideways from the machine housing and also solutions wherein angular nipples are provided for several of the inlets and outlets, even though the shown solution is preferred. It is also possible to arrange the nipple for flushing fluid on a nose element directed rearwardly instead of as an angular nipple which is shown on the drawings.

The invention claimed is:

1. Rock drilling machine having, on a machine housing, first attachment means on a first attachment side for fastening said rock drilling machine to a slide member which is movable back and forth along a feed beam, said first attachment means including a first contacting surface for co-operation with contacting means supported by the slide member and first fastening means for the engagement with fasteners co-operating with the slide member, wherein the rock drilling machine is also provided with second attachment means on a second attachment side being configured similarly to the first attachment means, said second attachment means including a second contacting surface and second fastening means, to allow the rock drilling machine to be fastened to the slide member also with the second attachment means.

2. Rock drilling machine according to claim 1, wherein each said contacting surface includes a shallow bottom hole for receiving a corresponding stud protruding from the slide member.

3. Rock drilling machine according to claim 2, wherein each said shallow bottom hole is of a circular section as seen in a direction perpendicular to the respective attachment side.

4. Rock drilling machine according to claim 2, wherein the first and second fastening means include holes for receiving screw fasteners.

5. Rock drilling machine according to claim 2, wherein the first and the second attachment sides face essentially opposite directions.

6. Rock drilling machine according to claim 2, wherein at least one inlet and at least one outlet of the group: lubrication air, percussion fluid, rotation fluid, flushing fluid, damper fluid into and out from the machine housing is located so as to be directed in a direction essentially opposite to the drilling direction of the machine.

7. Rock drilling machine according to claim 2, wherein all inlets and outlets in the housing of the group: lubrication air, percussion fluid, rotation fluid, flushing fluid, damper fluid are located on one and the same side of the machine housing which is not an attachment side.

8. Rock drilling machine according to claim 2, wherein all inlets and outlets in the housing of the group: lubrication air, percussion fluid, rotation fluid, flushing fluid, damper fluid are located at a distance from an end of the machine housing opposite to a drill string end.

9. Rock drilling machine according to claim 2, wherein a rotation unit extends from one side of the machine housing which is not an attachment side and that at least one accumulator unit extends from one side of the machine housing which is not an attachment side.

10. Rock drilling machine according to claim 2, wherein all inlets and outlets to and from the machine chosen from the group: lubrication air, percussion fluid, rotation fluid, flushing fluid, damper fluid, drainage fluid; are located on one and the same side, which is not an attachment side.

11. Rock drilling system including a drill rig with a said slide member which is movable back and forth along said feed beam, said contacting means supported by the slide member for engagement with said rock drilling machine, wherein said rock drilling system includes at least one rock drilling machine according to claim 2.

12. Rock drilling machine according to claim 1, wherein the first and second fastening means include holes for receiving screw fasteners.

13. Rock drilling machine according to claim 1, wherein the first and the second attachment sides face essentially opposite directions.

14. Rock drilling machine according to claim 1, wherein at least one inlet and at least one outlet of the group: lubrication air, percussion fluid, rotation fluid, flushing fluid, damper fluid into and out from the machine housing is located so as to be directed in a direction essentially opposite to the drilling direction of the machine.

15. Rock drilling machine according to claim 14, wherein the at least one inlet and at least one outlet in the housing of the group: lubrication air, percussion fluid, rotation fluid, damper fluid are directly directed in said direction essentially opposite to the drilling direction of the machine.

16. Rock drilling machine according to claim 1, wherein all inlets and outlets in the housing of the group: lubrication air, percussion fluid, rotation fluid, flushing fluid, damper fluid are located on one and the same side of the machine housing which is not an attachment side.

17. Rock drilling machine according to claim 1, wherein all inlets and outlets in the housing of the group: lubrication air, percussion fluid, rotation fluid, flushing fluid, damper fluid are located at a distance from an end of the machine housing opposite to a drill string end.

18. Rock drilling machine according to claim 1, wherein a rotation unit extends from one side of the machine housing which is not an attachment side and that at least one accumulator unit extends from one side of the machine housing which is not an attachment side.

19. Rock drilling machine according to claim 1, wherein all inlets and outlets to and from the machine chosen from the group: lubrication air, percussion fluid, rotation fluid, flushing fluid, damper fluid, drainage fluid; are located on one and the same side, which is not an attachment side.

20. Rock drilling system including a drill rig with said slide member which is movable back and forth along said feed beam, said contacting means supported by the slide member for engagement with said rock drilling machine, wherein said rock drilling system includes at least one rock drilling machine according to claim 1.

* * * * *

UNITED STATES PATENT AND TRADEMARK OFFICE

CERTIFICATE OF CORRECTION

PATENT NO. : 7,380,611 B2
APPLICATION NO. : 11/342164
DATED : June 3, 2008
INVENTOR(S) : Thomas Ostling It is certified that error appears in the above-identified patent and that said Letters Patent is hereby corrected as shown below:

Column 6, Line 1 (Claim 11):

Delete "a" (second occurrence)

Signed and Sealed this

Fifth Day of August, 2008

JON W. DUDAS
*Director of the United States Patent and Trademark Office*